United States Patent [19]

Nelson

[11] Patent Number: 4,533,315

[45] Date of Patent: Aug. 6, 1985

[54] INTEGRATED CONTROL SYSTEM FOR INDUCED DRAFT COMBUSTION

[75] Inventor: Lorne W. Nelson, Bloomington, Minn.

[73] Assignee: Honeywell Inc., Minneapolis, Minn.

[21] Appl. No.: 580,325

[22] Filed: Feb. 15, 1984

[51] Int. Cl.[3] ..... F23M 3/00

[52] U.S. Cl. ..... 431/20; 431/42; 431/59; 431/75; 431/90; 236/15 BD

[58] Field of Search ..... 431/12, 20, 42, 49, 431/59, 74, 75, 90; 236/15 BD, 15 E; 126/116 A; 110/185

[56] References Cited

U.S. PATENT DOCUMENTS

| | | | |
|---|---|---|---|
| 2,324,821 | 7/1943 | Campbell | 236/15 E |
| 2,352,143 | 6/1944 | Wills | 431/12 |
| 2,361,294 | 10/1944 | Jones | 236/15 E |
| 2,622,967 | 12/1952 | Lobosco | 422/96 |
| 4,118,172 | 10/1978 | Noir et al. | 431/12 |
| 4,334,855 | 6/1982 | Nelson | 431/20 |
| 4,468,192 | 8/1984 | Jaeger | 431/20 |

*Primary Examiner*—Margaret A. Focarino
*Attorney, Agent, or Firm*—Laurence J. Marhoefer

[57] ABSTRACT

An integrated, closed loop system for controlling the fuel to air ratio in an induced draft combustion chamber which has a control pilot through which a draft is induced so that the fuel to air ratio in the control pilot chamber has a predetermined ratio to the fuel to air ratio in the primary combustion chamber.

6 Claims, 7 Drawing Figures

INTEGRATED CONTROL SYSTEM FOR INDUCED DRAFT COMBUSTION

BACKGROUND OF THE INVENTION

This invention relates to a low cost, integrated, closed loop control system for providing efficient fuel utilization in induced draft, gas fired furnaces and boilers.

Power combustion (forced or induced draft) is used more and more frequently to increase the efficiency of gas fired furnaces and boilers that have either conventional or modified clam shell type heat exchangers. A prior art control system for forced draft furnaces and boilers is shown, by way of example, in U.S. Pat. No. 4,118,172.

With respect to induced draft combustion, in many existing boilers and furnaces the induced draft blower is located downstream of the heat exchanger and is used with an orifice, restricted flue passageway, or other similar device to produce a pressure drop which pulls the products of combustion from the combustion chamber into an existing chimney or into a through the wall exhaust pipe. Many of these existing systems use a single stage firing rate burner and an intermittent ignition device (IID). This in combination with a well designed heat exchanger and low off-cycle losses can provide Annualized Fuel Utilization Efficiencies (AFUE) in the range of 82–83%. However, such systems are costly. For example, code requirements in most locations dictate that such units incorporate one or two pressure switches to sense proof of combustion air, and a condition of a blocked stack.

SUMMARY OF THE INVENTION

A primary object of this invention is the provision of an integrated control system for induced draft combustion which can achieve a high AFUE with a relatively low cost control system. Some additional objects of the invention include the provision of:

(a) improved AFUE through reduced off-cycle loss;
(b) a capability to control to a condition of less excess air than with conventional systems;
(c) controlled staging of firing rate and excess combustion air to meet heating load requirement;
(d) a control system which can accomodate for variations in the BTU content of the fuel to maintain a predetermined amount of excess combustion air;
(e) a novel and low cost way to prove combustion air before opening the main fuel valve;
(f) a control system which reduces the firing rate in the event of a partially blocked stack to insure safe operating conditions without excessive carbon monoxide generation;
(g) a means for using a fuel control valve which has no separate pressure regulating function, and has an inexpensive valve actuator;
(h) high-low firing rates with conventional single stage thermostat;
(i) a low cost thermal operator to shorten the turn on time of the fuel control valve;
(j) a system which can be used with both high pressure loss heat exchangers and small pressure loss heat exchangers.

Briefly, this invention contemplates the provision of a control system for induced draft furnaces and boilers in which a flow passageway connects a secondary pilot to a venturi or other pressure reducing orifice in the primary flue so the flow from the secondary pilot can be related to the volumetric flow of the products of primary combustion. A supply of gas directly proportional to the gas flowing to the main burner during controlled operation fuels the secondary pilot and a flame rod located in the housing with the secondary pilot is used for sensing the flame ionization current of the secondary pilot to maintain it at a value slightly rich compared to stoichiometric conditions. In this way the excess air in the main burner can be precalibrated to any desired value by proportionally sizing the various gas and air orifices within the system.

DESCRIPTION OF THE PREFERRED EMBODIMENT

Figure 2:
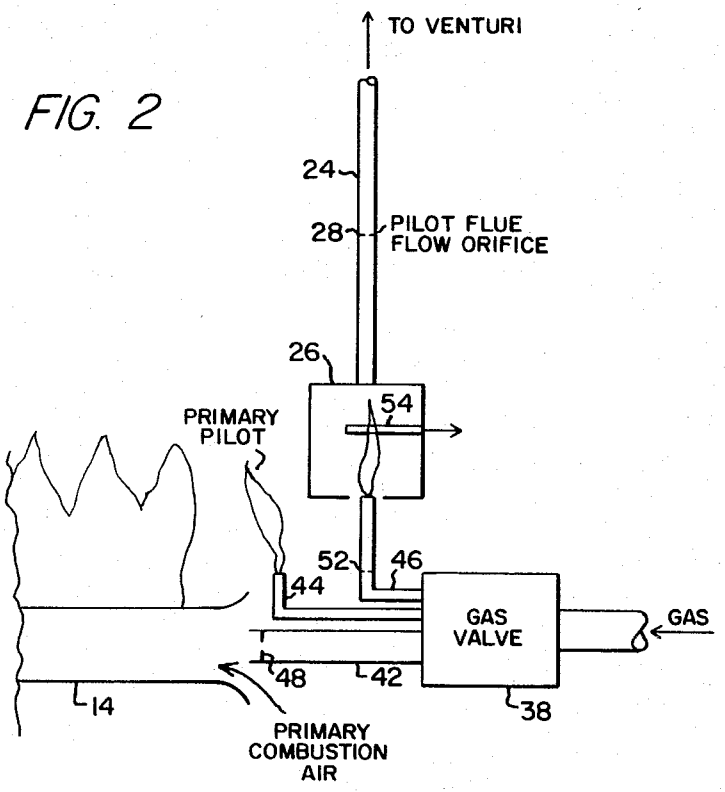
FIG. 2 is another schematic drawing showing details of the system shown in FIG. 1.
Figure 1:
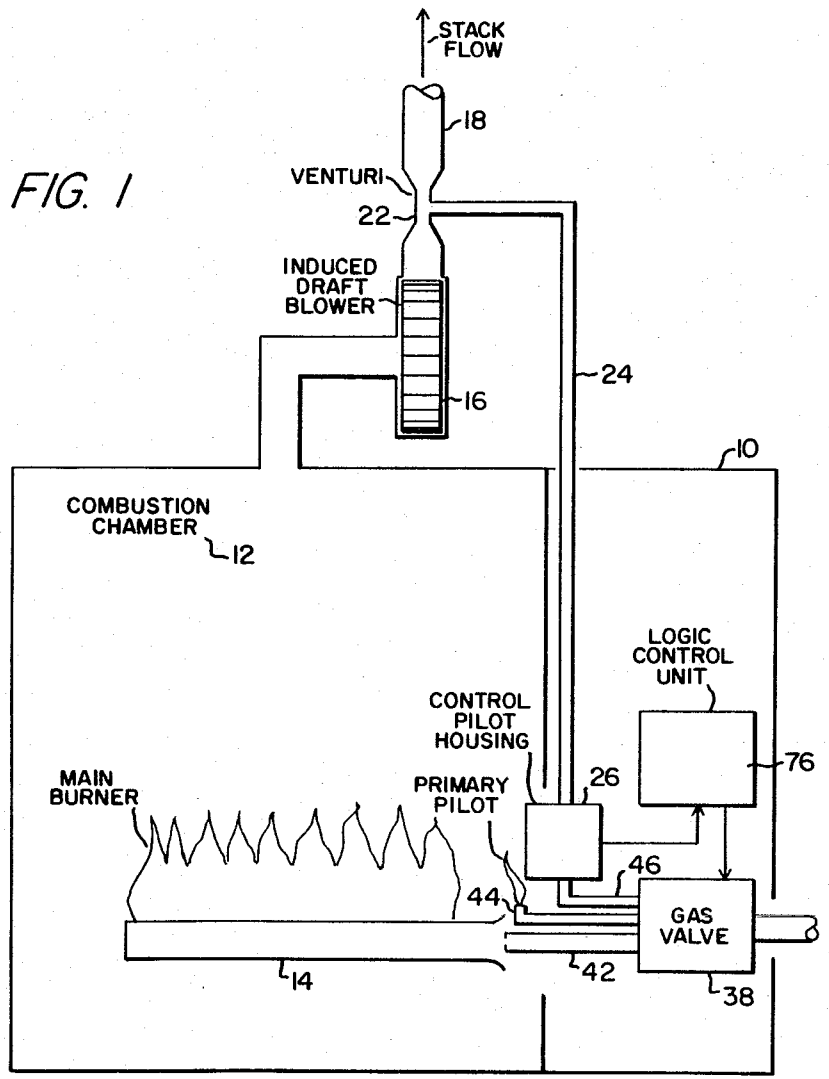
FIG. 1 is a schematic overall view of a gas fueled combustion chamber employing a control system in accordance with the teachings of this invention.

Referring now to FIGS. 1 and 2 of the drawing, a housing 10 surrounds a combustion chamber 12 in which a main burner 14 is located.

A blower 16 in a stack 18 draws air from outside the housing 10 through the combustion chamber 12. This air enters typically through a louver in the furnace housing and comprises both primary combustion air drawn directly into the main burner 14 and secondary combustion air drawn into the combustion chamber itself. A venturi 22 located on the downstream side of the blower 16 in the stack 18 provides a negative pressure the magnitude of which is directly related to the volumetric flow of the products of combustion out of the combustion chamber 12. A flow passageway 24 is connected from this venturi to a control pilot chamber 26.

Referring now to FIG. 2 as well as FIG. 1, as will be appreciated by those skilled in the art, the flow of combustion products from the control pilot to the venturi 22 can be made to have a known direct relationship to the flow of combustion products from the main combustion chamber. The venturi 22 provides equal pressure drops across combustion chamber 12 and the control pilot housing 26. Placing a suitable sized restriction 28 in passageway 24 is therefore a convenient way to adjust the ratio of air flow to a predetermined desired ratio.

Fuel for the main burner, primary pilot and a secondary pilot is supplied by a suitable gas valve 38 through passageways 42, 44 and 46 respectively. Orifice 48 in the main burner fuel supply and orifice 52 in the secondary fuel supply establish a predetermined proportion between the gas fuel supply to the control pilot and the gas fuel supply to the main burner during control operation.

A flame sensor 54, such as for example, a Kanthal flame rod, is located in the control pilot housing 26. It senses the flame ionization current of the control pilot. As will be appreciated by those skilled in the art, the flame ionization current has a peak value when the fuel-air ratio is at a certain value which is constant for all hydrocarbon fuels. This value is slightly fuel rich compared to stoichiometric conditions. By varying the valve opening of the gas valve 38 which feeds both the main burner 14 and the secondary pilot, this peak current value can be searched out and used as a control point, maintaining the fuel-air ratio in the secondary pilot housing at the slightly rich fuel-air ratio value under all conditions of operation.

Excess air in the main combustion chamber, comprised of both primary and secondary air, can be maintained at any desired value by selecting the proper ratios of the various gas and air orifices within the system. For example, the burner can be maintained at 30% excess air under all combustion air flow conditions (i.e., high-low speed blower, blocked stack, etc.) while the secondary pilot is regulating the gas pressure to maintain a peak flame current. The gas orifices 48 and 52 have been previously mentioned. The easiest way to establish a desired ratio between air flowing through the combustion chamber 12 and air flowing through the control pilot housing 26 is to adjust or select the pilot flue orifice 28 to give the desired ratio.

Figure 3:
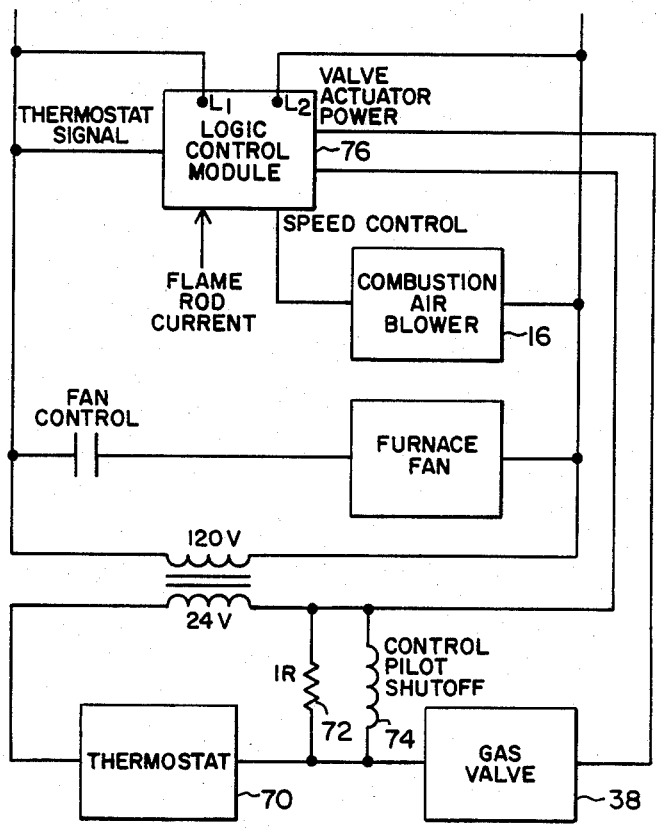
FIG. 3 is a schematic block diagram of an electrical and electronic control system in accordance with the teachings of this invention.

Referring now to FIG. 3, it illustrates a typical sequence of operation and a control system therefore. Upon a call for heat from a thermostat 70, a combustion air blower relay coil 72 and a control pilot valve solenoid coil 74 are energized. A relay contact suitable in logic control module 76 starts the combustion air blower 16: (a) in a high speed operating mode—if it is desired to bring the heat exchanger up to temperature fast in order to reduce condensation; otherwise (b) in a low speed operating mode. If initially high speed operation is selected, when the temperature of the heat exchanger reaches the dew point of the flue gas, the control logic module 76 reduces blower speed to its low speed operation. Any suitable control logic module known in the art may be used.

Figure 4:
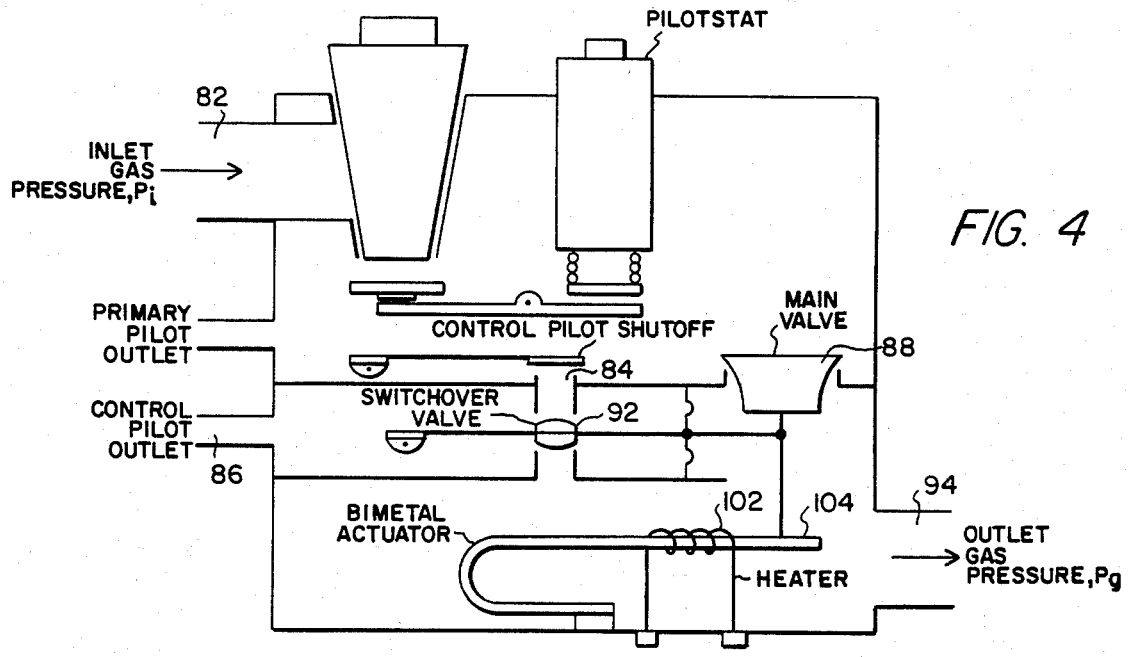
FIG. 4 is a schematic drawing of a gas control valve useful in the practice of this invention.

FIG. 4 shows an embodiment of a gas valve which may be used in the practice of the invention. Referring to FIG. 4 as well as the previous Figures, energizing the control pilot valve solenoid 74 permits the inlet gas at port 82, which is at a pressure Pi, to be transmitted to the control pilot housing 26 via ports 84 and 86 while a main valve 88 remains closed and a secondary pilot switch over valve 92 is in its lower position. The main gas pressure port 94 is thus closed while inlet gas is supplied to the control pilot through port 86. The combustible mixture in the control pilot unit 26 is ignited from the main burner pilot which is in a close proximity to the secondary pilot housing, as will be explained in more detail in connection with FIG. 5A and 5B.

If the stack 18 is operating properly and inducing a proper air flow through the control pilot housing 26, the combustible gas mixture in the control pilot is ignited. If, on the other hand, ignition is not sensed by a flame current sensor (not shown), the system should not be permitted to continue and would go into a lock-out mode, as is customary in the art.

Figure 5A:
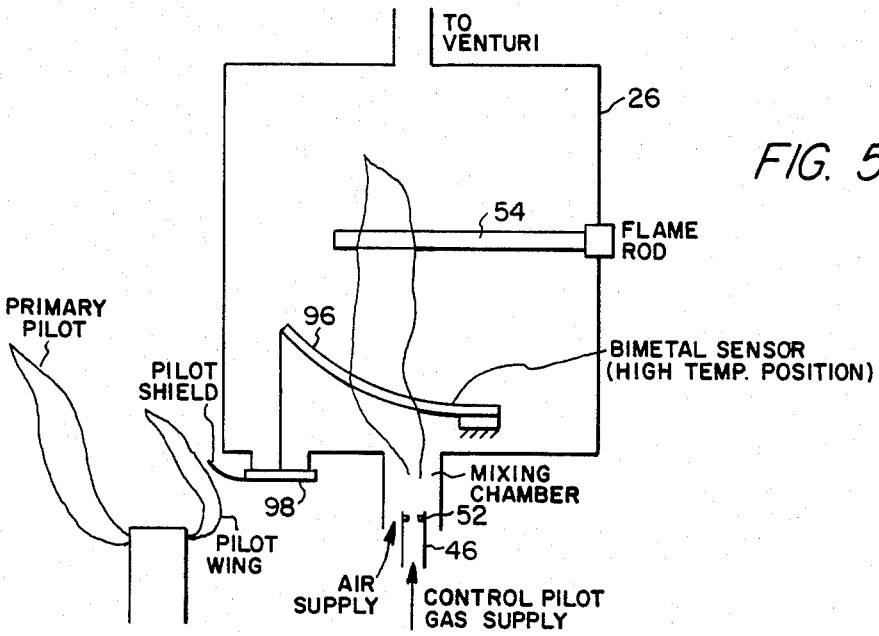
FIGS. 5A and 5B are schematic diagrams of a secondary pilot and its on and off positions respectively.
Figure 5B:
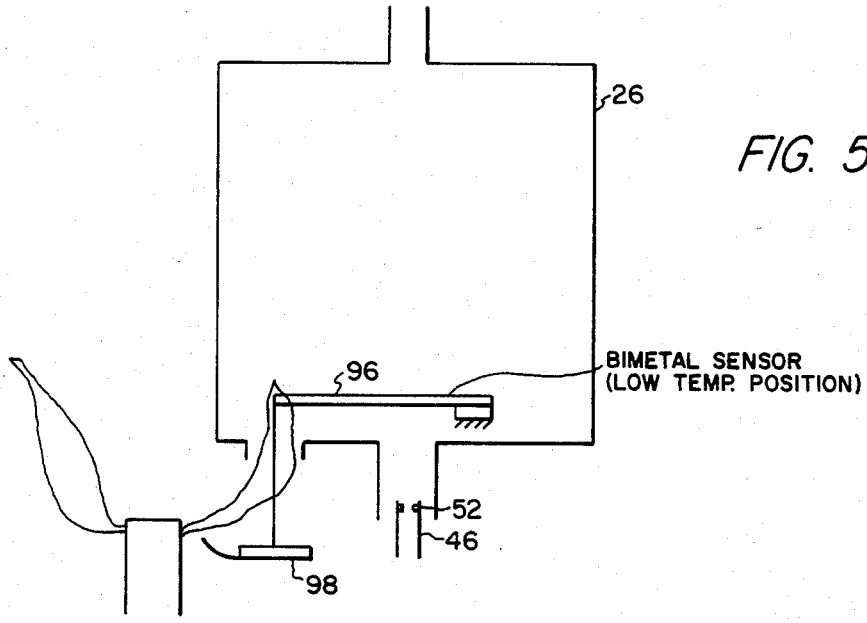

Referring now to FIGS. 5A and 5B, upon successful ignition of the secondary pilot, a bimetal beam 96, in effect detects the secondary pilot flame and warps a pilot shield 98 into place, deflecting the main pilot flame so that it does not continue to enter the secondary housing assembly.

Assuming control pilot combustion is sensed, the control logic module 76 energizes a heater coil 102 thermally coupled to a bimetalic actuator 104 connected to the main gas control valve 88. While a bimetal control actuator is illustrated, any suitable proportional actuator known to the art would be satisfactory.

When the bimetalic actuator 104 applies sufficient force to the valve stem of the main control valve 88, it snaps open to a "minimum fire" position. At the same time, the pilot switch over valve 92, which is connected to the main valve 88, moves from its lower position to its top position (as shown in FIG. 4) changing the supply of control pilot gas supply from the inlet to the controlled gas outlet.

The strategy and system for controlling the fuel to air ratio of the combustion products in the control pilot can be the same as that employed in the prior art for controlling the fuel to air ratio of combustion products using a flame rod. That is the peak value of flame rod current is automatically sought out and maintained by varying the fuel to air ratio in the control pilot. In the present system the flame rod current from the flame rod 54 in the control pilot housing is coupled to the input of the logic control module 76. Its output regulates the main control valve 88 via heater 102 to seek and establish a peak flame current. In the system of this invention the fuel to air ratio in the primary combustion chamber is proportional to the fuel to air ratio in the control pilot. Therefore combustion products can be maintained at a predetermined condition of excess air. The quantity of excess air is established most easily, as previously mentioned by properly proportioning the restrictions 28, 48 and 52. Changes in combustion air flow due to a requirement of high or low firing rate, or a decreased air flow due to a blocked stack, are compensated for automatically by a change in the gas flow to maintain the predetermined excess air.

It should be noted that in the preferred embodiment of the gas control valve shown in FIG. 4, the valve actuator is positioned within the valve. This shortens the time required to open and close the valve upon a call for heat. Since the bimetal operator and its heater are not subject to a gas flow during the initial start up when the valve was closed, the heater can efficiently and rapidly increase the bimetal temperature.

Figure 6:
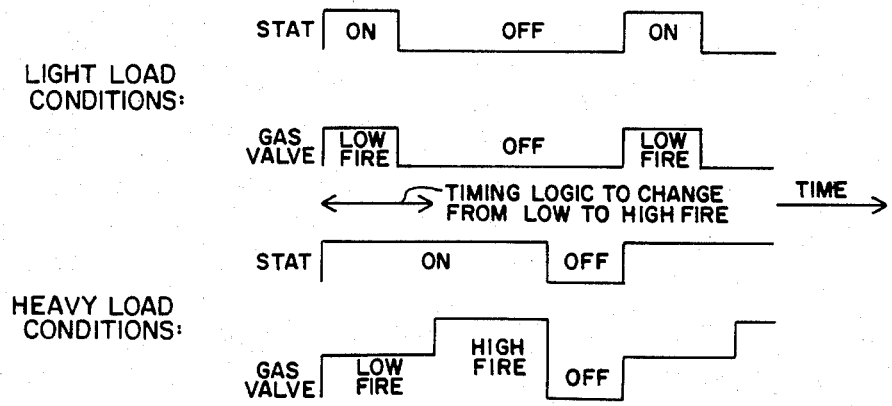
FIG. 6 is a timing diagram showing the control sequence for a heavy load condition.

The AFUE of the closed loop control system of this invention may be increased by providing low fire in the combustion chamber during light heating loads and providing high fire only during times when needed; startup cycle, cold weather and morning pickup. The operation providing this functional feature is shown in FIG. 6. In this case the system operates at low fire for a preset period of time for each thermostat call for heat. The combustion stops after the call for heat has stopped. If the thermostat calls for heat for a period longer than the preset period of time it is indicative that the heating load has increased and logic control module will cause a change to high combustion air flow after the preset interval if heat is still called for and correspondingly high fire as illustrated in FIG. 6. This two stage operation and its higher efficiency can be achieved with a single stage thermostat.

There is another system feature which can be used to shorten the heat up time. Prior to the time the main valve 88 opens the flow of gas to the control pilot is from the inlet 82 at a relatively high pressure. This relatively high pressure results in a fuel-rich pilot flame and a relatively low flame current. Immediately after the main valve 88 opens to its minimum fire position the switchover valve 92 closes port 84 and directs the relatively low controlled pressure of outlet 94 to the control pilot. This results in an air rich pilot flame and also a relatively low flame current. During this transition the correct fuel-air ratio occurs in the pilot to provide a maximum flame current condition. This transient spike in flame current can be used as a signal to the control module 76 to cause it to supply heater 102 coupled the bimetal 104 with a high current initially compared to current used after the valve opens, thereby further shortening the opening time.

What is claimed is:

1. A system for controlling the fuel to air ratio in an induced draft combustion chamber comprising in combination:

a combustion chamber;

a gas fuel burner in said combustion chamber;

means for supplying fuel to said combustion chamber fuel burner;

means for inducing a flow of air in said combustion chamber to support combustion of said fuel;

a control pilot chamber;

a gas fuel burner in said control pilot chamber means for supplying fuel to said control pilot burner;

means for establishing a proportional ratio between the quantity of fuel fed to the combustion chamber burner and the quantity of fuel fed to said control pilot burner;

means coupling said control pilot chamber to said means for inducing a flow of air so that a quantity of air drawn through said control pilot chamber is proportional to the quantity of air drawn through said combustion chamber; and means for controlling the fuel to air ratio in said control pilot chamber.

2. A system as in claim 1 wherein said control means includes a flame rod.

3. A system as in claim 1 wherein said means for inducing a flow of air for said combustion chamber includes a flue and a venturi in said flue and said means for coupling connects said control pilot chamber to said venturi.

4. A system as in claim 1 wherein said means for supplying fuel to said combustion chamber burner and said means for supplying fuel to said control pilot burner includes;

a control valve;

said control valve having a main gas inlet and an outlet to said combustion chamber burner;

means to regulate the flow between said inlet and said outlet; and means to initially supply fuel from said inlet to said control pilot fuel supply means when said regulating means is closed, and to supply fuel from said outlet to said control pilot fuel supply means when said regulating means are open.

5. A system as in claim 1 wherein said means for controlling the fuel to air ratio in said pilot chamber includes:

means for establishing a maximum flame current or maximum flame temperature in said control pilot chamber independently of the fuel heat content of said gas, whereby the fuel to air ratio in said combustion chamber can be established at an optimum desired ratio based upon the proportionality between the control pilot chamber and combustion chamber.

6. A system as in claim 4 wherein the fuel to air ratio in said pilot chamber rapidly passes through the stoichiometric ratio as said fuel supply switches from inlet to said outlet.

* * * * *